United States Patent [19]

Missalla

[11] Patent Number: 4,981,240

[45] Date of Patent: Jan. 1, 1991

[54] NUT DISPENSER

[76] Inventor: Manfred F. Missalla, 52 Shieldmark Crescent, Thornhill, Ontario, Canada, L3T 3T5

[21] Appl. No.: 381,785

[22] Filed: Jul. 19, 1989

[30] Foreign Application Priority Data

Jul. 21, 1988 [CA] Canada ..... 572695

[51] Int. Cl.[5] ..... B65D 91/00

[52] U.S. Cl. ..... 222/129; 206/216; 221/102; 232/43.1; 222/192

[58] Field of Search ..... 221/102, 97, 191, 194; 206/216, 233; 232/43.1, 43.5; 222/129, 192

[56] References Cited

U.S. PATENT DOCUMENTS

| | | | |
|---|---|---|---|
| 933,883 | 9/1909 | Bryant | 232/43.1 X |
| 1,640,583 | 8/1927 | Steinruck | 222/457 |
| 1,915,522 | 6/1933 | Eriksen | 221/102 X |
| 2,352,685 | 7/1944 | Brinker | 232/43.1 |
| 2,382,932 | 8/1945 | Young | 221/102 |
| 2,602,584 | 7/1952 | Croft, Jr. | 232/43.1 |
| 3,372,837 | 3/1968 | Neumann | 221/102 X |
| 4,009,818 | 3/1977 | Rogers | 232/43.1 X |
| 4,151,910 | 5/1979 | Yasur | 221/102 X |

*Primary Examiner*—Kevin P. Shaver

[57] ABSTRACT

Apparatus for dispensing products having a useful portion and a waste portion and having a storage chamber for storing the products, an opening in the lower end of the chamber for discharge of products, a tray beneath the opening for receiving products, a waste chamber associated with the storage chamber, and, a waste opening at the upper end of waste chamber.

4 Claims, 1 Drawing Sheet

NUT DISPENSER

Figure 1:
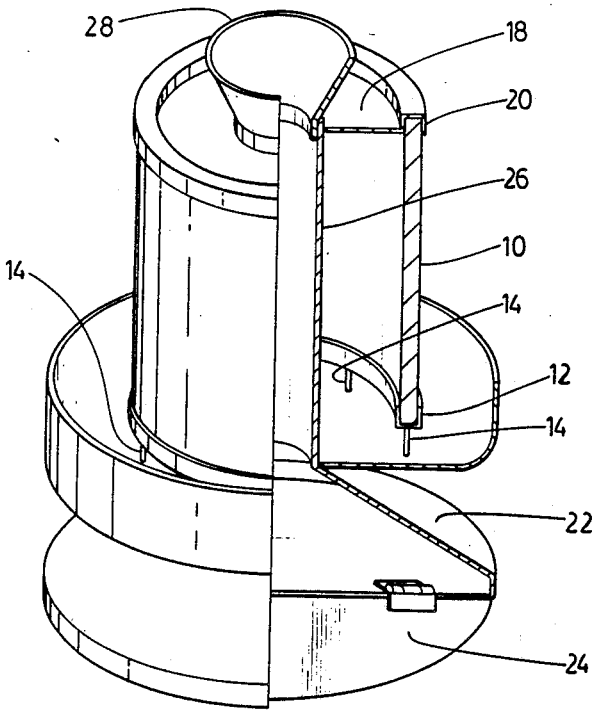

The invention relates to apparatus for dispensing products such as edible nuts, or other such products wherein a waste portion of the product must be discarded.

BACKGROUND OF THE INVENTION

A variety of different products are available where, for example, the shell portion, or a wrapper, or some other portion must be discarded as waste each time the product is used.

A typical example is edible nuts. Generally speaking the eating of nuts is a somewhat messy procedure. The shells seem to take up more space when they are discarded, than the nuts originally occupied.

Generally speaking, it is necessary to have two bowls, one for the whole nuts, and another for the discarded shells.

Typically, nuts are eaten as a snack, for example, while having a social drink with friends, or while watching television. Clearly, it is a nuisance if each time nuts are to be consumed, two bowls must be put out, and then removed.

It would be more convenient if nuts could be stored, for example, in the family room or television room, ready for consumption without having to be brought out and cleared up each time.

In addition, the packaging of such products, such as nuts, for sale is generally achieved simply by the use of a clear plastic bag, or a cardboard carton. In either case, dispensing the nuts directly from the package is generally speaking unsatisfactory, and the packages usually present a not particularly pleasing appearance, as a serving vessel.

For all of these reasons it is considered desirable to provide an attractive dispenser for products such as nuts, which container will also store the waste from the products.

BRIEF SUMMARY OF THE INVENTION

With a view to overcoming the various problems noted above, the invention comprises an apparatus for dispensing products having a useful portion and a waste portion and comprising storage chamber means having an upper end and a lower end for storing said products, opening means in said lower end for discharge of products therefrom, tray means beneath said opening means for receiving products discharged therefrom, waste storage means associated with said chamber means having an upper and a lower end, and, waste opening means at said upper end of said waste storage means for receiving said waste portions of said products.

More particularly, it is an objective of the invention to provide such an apparatus wherein the storage chamber means may be refilled, and wherein the waste storage means may be emptied to provide for reuse.

More particularly, it is an objective of the invention to provide an apparatus having the foregoing advantages, designed as a package for display and sale.

The various features of novelty which characterize the invention are pointed out with more particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 2:
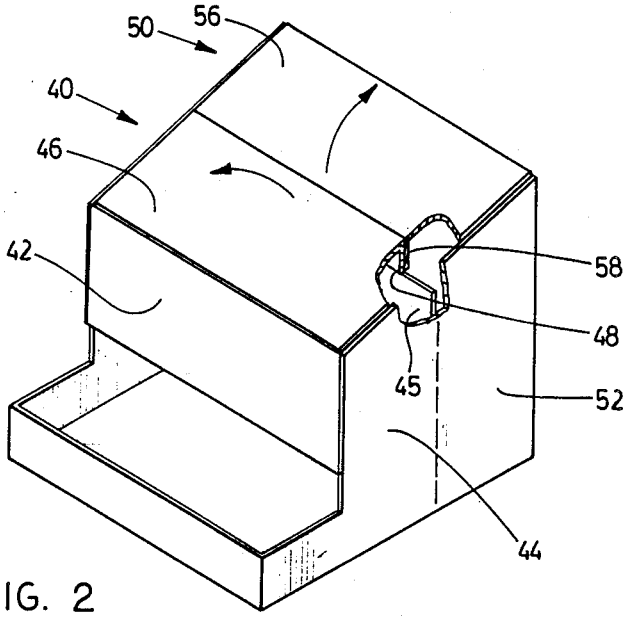

FIG. 1 is a perspective illustration of a dispensing apparatus in accordance with the invention, partially cut away, and, FIG. 2 is a front perspective illustration of an alternate embodiment of the invention, partially cut away.

Referring first of all to FIG. 1, the invention is there illustrated in the form of a dispenser apparatus which may be refillable and reuseable if desired. For this purpose it defines a storage chamber 10, in this case, having a generally cylindrical shape in appearance, and preferably being made of transparent material such as transparent plastic.

A lower annular channel 12 supports the chamber 10. Channel 12 is mounted on a plurality of spaced-apart legs 14 which are, in turn, rooted on a generally circular dispensing tray 16. The bottom of the chamber 10 will typically be left open.

The top of chamber 10 may be closed by a closure 18 resting on an annular channel 20.

Tray 16 is mounted on a hollow base or stand 22 which in this embodiment is of flaring conical shape. In this embodiment, a hinged closure panel 24 may be provided on the underside of the base 22 for reasons to be described.

Located centrally within chamber 10, and connected to base 22, is a tubular waste receptacle 26, having at its upper end a flared frusto-conical open funnel 28.

Funnel 28 may be removeable from receptacle 26 to permit removal of closure 18, for this purpose funnel 28 may have a cuff portion 30 making a sliding fit in the upper end of receptacle 26.

In use, nuts are placed in the chamber 10, and fall downwardly onto tray 16. From tray 16 nuts may be selected for consumption. The shells are then placed in the open mouth 28, and dropped into the base 22.

From time to time the base 22 may be emptied by use of the closure 24.

While the embodiment of FIG. 1 may, in some cases, be used as a display package for selling the nuts at retail: in other cases, it may be sold separately for filling by the customer.

The embodiment of FIG. 2 is intended to be used as a disposable package. This embodiment will typically be made of cardboard, although other materials may be suitable in some circumstances.

It will have a chamber 40 at the front formed in this embodiment, by front wall 42, side walls 44 and partition wall 45. A lid 46 having a closure flap 48 closed the top of chamber 40. Lid 46 lies at an angle, for reasons to be described. The lower end of chamber 40 is open.

Integrally formed with chamber 40 is a waste receptacle 50. Receptacle 50 is of generally rectangular shape, having side walls 52, and a rear wall 54, and a hinged lid 50 with a closure flap 58.

Side walls 52 are taller than side walls 44, and lid 56 lies at an angle corresponding to lid 46 so that they lie in a common plane.

A dispenser tray 60 is formed by bottom wall 62, side walls 64, and front wall 66.

In use, nuts will fill the chamber 40, and the tray 60, being covered by a removable wrapper, typical of clear plastic. For consumption nuts can be selected from tray 60, and shells can be discarded in chamber 50.

When all the nuts are consumed the entire package can then be disposed of.

The foregoing is a description of a preferred embodiment of the invetion which is given here by way of example only. The invention is not to be taken as limited to any of the specific features as described, but comprehends all such variations thereof as come within the scope of the appended claims.

What is claimed is:

1. Apparatus for dispensing products having a useful portion and a waste portion and comprising:

storage chamber means for storing said products and having an upper end and a lower end, and defining a front portion and a back, said back portion having a predetermined height;

opening means for discharge of products therefrom in said lower end;

tray means beneath said opening means for receiving products discharged therefrom;

waste chamber means for storage of waste portions and associated with said back portion of said storage chamber means and having an upper and a lower end and defining a front portion and a back, said back portion of said waste chamber means having a predetermined height greater than said predetermined height of said back portion of said storage chamber means;

waste opening means at said upper end of said waste chamber means for receiving said waste portions of said products;

storage chamber lid means hingedly secured to said front portion of said storage chamber means and extending upwardly at an angle towards said back portion thereof, and, waste chamber lid means hingedly secured to said back portion of said waste chamber means and extending downwardly at an angle towards said front portion thereof.

2. Apparatus for dispensing products as claimed in claim 1 wherein said storage chamber means and said waste chamber means are located side by side with one another.

3. Apparatus for dispensing products as claimed in claim 2 wherein said storage chamber means and said tray means are formed integrally with one another, said tray means extending forwardly from said front portion of said storage chamber means and wherein said waste chamber means is formed integrally with said back portion of said storage chamber means.

4. Apparatus for dispensing products as claimed in claim 3 wherein said storage chamber lid means, and said waste chamber lid means, lie in a common plane, and including closure flap means on both said lid means, adapted to lie adjacent to one another, along the junction between said storage chamber means and said waste chamber means.

* * * * *